US005426574A

United States Patent [19]

Carolfi

[11] Patent Number: 5,426,574

[45] Date of Patent: Jun. 20, 1995

[54] STREET-LAMP WITH FOG LIGHTING DEVICE

[76] Inventor: Gianni Carolfi, Via Settevenepalo Km.6,400, 00069 Trevignano Romano(RM), Italy

[21] Appl. No.: 28,173

[22] Filed: Mar. 9, 1993

[30] Foreign Application Priority Data

Jun. 12, 1992 [IT] Italy ..... RM92U0133

[51] Int. Cl.[6] ..... F21V 21/10

[52] U.S. Cl. ..... 362/249; 362/231; 362/410; 362/431

[58] Field of Search ..... 362/153, 153.1, 231, 362/249, 410, 431

[56] References Cited

U.S. PATENT DOCUMENTS

| | | | |
|---|---|---|---|
| 1,756,144 | 4/1930 | Ames | 362/431 |
| 2,165,211 | 7/1939 | Bass et al. | 362/228 |
| 2,456,179 | 12/1948 | Finer | 362/431 |
| 2,793,286 | 5/1957 | Stiffel | 362/431 |
| 5,215,369 | 6/1993 | Carolfi | 362/83 |

FOREIGN PATENT DOCUMENTS

| | | | |
|---|---|---|---|
| 749910 | 5/1933 | France | 362/431 |
| 1216689 | 11/1959 | France | 362/431 |
| 3437821A1 | 4/1986 | Germany . | |
| 158667 | 2/1933 | Switzerland | 362/431 |

*Primary Examiner*—Ira S. Lazarus
*Assistant Examiner*—Alan B. Cariaso
*Attorney, Agent, or Firm*—Beveridge, DeGrandi, Weilacher & Young

[57] ABSTRACT

Street-lamp (1) comprising a supporting member (2), equipped with two or more conventional lighting units (3), and one or more fog light units (4), fastened to said supporting member (2) at a distance from the ground (7) not less than the maximum height of a truck trailer, said fog light units (4) being dimensioned and arranged such that beams of light (5) projected from said fog light units (4) form angles comprised from 0 to 90 degrees upwards with respect to a plane parallel to the ground (7) and passing through the relevant light source.

11 Claims, 1 Drawing Sheet

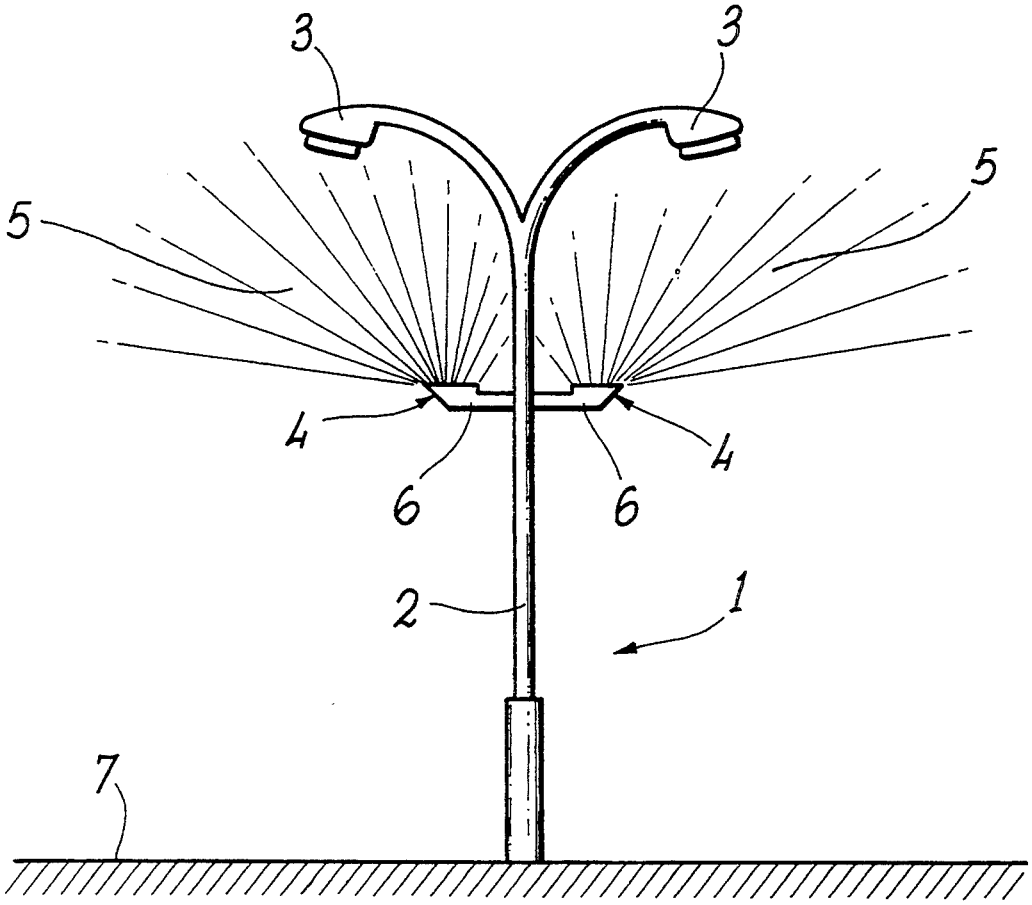
3
3
5
5
4
4
6
6
2
1
7

STREET-LAMP WITH FOG LIGHTING DEVICE

This invention relates to a street-lamp with a fog lighting device. More particularly, this invention relates to a fog light system with indirect lighting, wherein the beams of light projected from the fog lamps are oriented in such a way as to allow a better visibility under foggy weather conditions.

The street-lighting systems presently in use generally consist of light-projecting assemblies, fitted at the top of posts that are located near the roadway; said lighting assemblies project the light beams downwards onto the roadway. Although this arrangement is normally the most effective, it does not guarantee a satisfactory visibility under foggy conditions.

The tiny droplets of water suspended in the air making up the fog reflect the incident light and, when they are hit from a light beam directly, they form a white and opalescent barrier. The latter does not allow any visibility through it, and this causes serious problems to the motor drivers, who are unable to identify any obstacle along their path.

As a matter of fact, the attempt to directly light the roadway actually causes reduced visibility in the presence of fog. The existing fog lighting aims only at piercing or penetrating the fog between the light source and the zone to be lit, by projecting the light beams directly towards the roadway.

Therefore, an object of the present invention is to provide a road lighting system suitable for foggy weather conditions, which overcomes the above mentioned problems and allows the vehicles to ride more safely when the visibility is poor.

The system according to this invention aims at exploiting the reflection effect created by the lit fog, rather than attempting to penetrate it by means of a direct lighting. This is obtained by projecting the light beams not directly onto the roadway, but upwards, in order to light the zone overhanging the roadway. The zone close to the ground must not be hit directly by the light beams; on the contrary it shall be illuminated by the reflecting and diffusing overhanging fog, that is hit directly by the light beams. Thus, an indirect roadway lighting is obtained by allowing a ground-parallel lit layer to form, said layer being located at a certain height with respect of the ground and reflecting downwards.

According to the present invention, there is suggested to equip the existing street-lights with additional fog lighting elements, to be employed in case of fog instead of the ordinary lighting. Said fog lighting elements are suitable lamp units shaped and oriented in such a way as to project the light beams upwards.

In one embodiment of the invention the fog light units are positioned vertically below conventional street lighting units, but closer in vertical height to the conventional street lighting units than to the ground below. Also, the fog light units include arm extensions that space the light source away from a central supporting pole or member.

Accordingly, this invention specifically provides a street-lamp with a fog lighting device, comprising a supporting member, equipped on top with one or more lighting units, characterised in that it further comprises a fog lighting device comprising one or more fog light units, fastened to said supporting member at a distance from the ground not less than the height of a truck trailer, said fog light units being dimensioned and arranged such that beams of light projected from said fog light units form angles comprised from 0 to 90 degrees upwards with respect to a plane parallel to the ground and passing through the relevant light source.

The fog light units are fastened to the street-lamp supporting member at a level from the ground which is higher than the maximum height of a truck trailer, thus allowing the largest vehicles to pass through the zone not directly lit. However, in order to optimise the indirect lighting effect of the fog, the fog lamps should not be too high from the ground.

The present invention sharply limits the light projected from said fog lighting devices towards the ground, thus preventing any light beam from extending downward from the plane parallel to the roadway and passing through the light source. The street-lamp according to this invention is preferably equipped with an opaque screen around its light source.

Although it is more convenient to use the supporting members of the existing lighting apparatus to provide a support for the additional lights according to this invention, the technical teachings of this invention could be also applied by designing a set of autonomous fog lighting street-lamps, separate from the conventional downward-oriented street-lamps.

The invention will be disclosed below by way of a non limitative example, with reference to a preferred embodiment thereof. Said embodiment is illustrated by the enclosed drawing.

The enclosed figure schematically shows a street-lamp (1), comprising a vertical supporting member (2) and a couple of conventional lighting units (3). The lighting units (3) are shaped so as to project their light beams downwards.

The street-lamp (1) is further equipped with a pair of fog light units (4) of the indirect lighting type, to be employed instead of the conventional lighting units (3) in case of foggy weather conditions. As schematically shown in the figure, the fog light units (4) project their light beams (5) upwards, and are equipped with opaque screens (6). Said opaque screens (6) are designed to prevent any light beam from reaching the zone below a plane parallel to the roadway (7) and passing through the relevant light source.

As pointed out in the foregoing, the fog light units (4) must be mounted on the supporting member (2) at a higher distance from the ground than the height of the largest road vehicles; provided that said requirement is met, however, said distance should be as low as possible, in order to allow the optimal exploitation of the reflection effect of the lit fog.

The street-lamp according to this invention is very effective in improving visibility in the fog and is even more effective when the fog gets thicker. However, in order to reach the optimised visibility on the road, the vehicles could be advantageously equipped with the fog lights disclosed in the EP-A-0 517 995, of the same applicant. Said document discloses a front section of a motor vehicle with indirect fog lighting equipment.

This invention is described with specific reference to some preferred embodiments thereof, but it is to be understood that modifications and/or changes could be made by those who are skilled in the art without departing from the true spirit and scope thereof.

I claim:

1. A street-lamp (1) comprising a supporting member (2) equipped on top with one or more lighting units (3), said street-lamp further comprising a fog lighting device comprising one or more fog light units (4), said fog light unit or units being fastened to said supporting member (2) at a distance from the ground (7) not less than the maximum height of a truck trailer, said fog light unit or units (4) being dimensioned and arranged such that beams of light (5) projected from said fog light unit or units (4) form angles comprised from 0 to 90 degrees upwards with respect to a plane parallel to the ground (7) and passing through a light source of said one or more fog light units, and wherein each of said fog light unit or units includes an extension arm supported at a first end by said supporting member and extending away from said supporting member, and said extension arm providing support to the light source at an end opposite said first end.

2. A street-lamp (1) according to claim 1, wherein each fog light unit (4) is fastened to said supporting member (2) at a level from the ground slightly higher than the maximum height of a truck trailer.

3. A street-lamp (1) according to claim 1, wherein each fog light unit (4) comprises an opaque shield around said light source, that prevents visible light beams (5) from extending downward.

4. A street-lamp (1), comprising a supporting member (2) equipped on top with one or more fog light units (4), placed at a level from the ground higher than the maximum height of a truck trailer, each one of said fog light units (4) being dimensioned and arranged such that beams of light (5) projected from said one or more fog light units (4) form angles comprised from 0 to 90 degrees upwards with respect to a plane parallel to the ground (7) and passing through a light source of said one or more fog light units and wherein each of said fog light unit or units includes an extension arm supported at a first end by said supporting member and extending away from said supporting member, and said extension arm providing support to the light source at an end opposite said first end.

5. A street-lamp (1) according to claim 4, wherein each of said fog light units or units (4) is fastened to said supporting member (2) at a level from the ground slightly higher than the maximum height of a truck trailer.

6. A street-lamp (1) according to claim 4, wherein said fog light unit or unit (4) comprises an opaque shield around said light source, that prevents visible light beams (5) from extending downward.

7. A street lamp (1) according to claim 2, wherein said fog light unit or units (4) comprises an opaque shield around said light source, that prevents visible light beams (5) from extending downward.

8. A street-lamp (1) according to claim 5, wherein said fog light unit or units (4) comprises an opaque shield around said light source, that prevents visible light beams (5) from extending downward.

9. A street-lamp according to claim 1 wherein said fog light unit or units are positioned vertically closer to a vertical height of said one or more lighting units than to the ground below.

10. A street-lamp according to claim 1 wherein said fog light unit or units are illuminated instead of said one or more lighting units in foggy conditions.

11. A street-lamp according to claim 4 wherein said fog light unit or units provide the sole source of light on said street lamp.

* * * * *